US005855808A

United States Patent [19]

DiBerardino

[11] Patent Number: 5,855,808

[45] Date of Patent: Jan. 5, 1999

[54] CONCRETE FORMING MEMBER

[75] Inventor: Frank B. DiBerardino, Benicia, Calif.

[73] Assignee: Damage Prevention Products Corp., Benecia, Calif.

[21] Appl. No.: 957,392

[22] Filed: Oct. 23, 1997

Related U.S. Application Data

[63] Continuation of Ser. No. 757,138, Dec. 3, 1996, abandoned, which is a continuation of Ser. No. 255,784, Jun. 8, 1994, abandoned.

[51] Int. Cl.[6] ..... B28B 7/34

[52] U.S. Cl. ..... 249/114.1; 249/31; 249/175; 249/184; 249/DIG. 2; 249/134

[58] Field of Search ..... 249/31, 61, 62, 249/113, 114.1, 115, 134, 176, 183, 184, 189, DIG. 2, 175; 52/309.4, 309.6, 309.8, 309.9, 309.14

[56] References Cited

U.S. PATENT DOCUMENTS

| | | | |
|---|---|---|---|
| 2,775,019 | 12/1956 | Bemis | 249/31 |
| 2,823,442 | 2/1958 | Miller et al. | 249/31 |
| 3,381,929 | 5/1968 | Bancker . | |
| 4,832,308 | 5/1989 | Slonimsky et al. | 249/189 |
| 5,074,517 | 12/1991 | Scott | 249/134 |
| 5,098,059 | 3/1992 | Sawyer | 249/134 |
| 5,302,099 | 4/1994 | Seratini | 249/189 |

*Primary Examiner*—James P. Mackey
*Attorney, Agent, or Firm*—Morrison & Foerster LLP

[57] ABSTRACT

This invention is a paper-based concrete form member and a method for using it. The forms may be made from layers of paper honeycomb material or corrugate. The forms may be structured to be hollow, if so desired. They are principally useful in forming recesses or voids in concrete structures although they may be used to form the edges of concrete products during construction of these products.

12 Claims, 4 Drawing Sheets

CONCRETE FORMING MEMBER

This application is a continuation of application Ser. No. 08/757,138, filed Dec. 3, 1996, now abandoned, which is a continuation of application Ser. No. 08/255,784, filed Jun. 8, 1994, now abandoned.

FIELD OF THE INVENTION

This invention is a paper-based concrete form member and a method for using it. The forms may be made from layers of paper honeycomb material or corrugate. The forms may be structured to be hollow, if so desired. They are principally useful in forming recesses or voids in concrete structures although they may be used to form the edges of concrete products during construction of these products.

BACKGROUND OF THE INVENTION

During the construction of buildings, parking structures, and the like, concrete is often the material of choice for floors, walls, supporting structures, and other building components. It is recognized that substantial voids may be specifically placed within the poured concrete structures to minimize the volume of concrete introduced into the structure and hence minimize the resulting cost, but without substantially affecting the strength of that resulting structure. It is common, for instance, to pour a concrete floor over a number of boxes so as to form an egg-crate shape on the bottom side of the structure. The region between the recesses may be considered as concrete beams.

Formation of such recesses in concrete structures is typically through the use of wood or metal forms. Obviously, such forms are often difficult or impossible to remove from the underside of a concrete structure. Moreover, the presence of those unremoved forms may add significant weight and corrodible (or termite-infestable) components to the structure. Some have proposed the use of paper forms to produce voids in concrete structures.

U.S. Pat. No. 2,823,442, to Miller et al., teaches the use of a carton form suitable for the production of recesses or voids in concrete wall or floor structures. The form is in the shape of a longitudinal tray constructed of folded corrugate sheets. The tray is supported in a rigid fashion by a filler structure also formed of corrugate. The filler is produced by folding a corrugate strip into a zig-zag series of folds so to form rectangles. The ends of the folded rectangles are stapled to the interior sides of the trays to form webs within the resulting rigid box. The corrugate may be waterproofed or lubricated so, respectively, to provide additional structural strength during the pouring step or to allow removal of the form after the curing step.

U.S. Pat. No. 3,512,747, to Stark, describes a form used in producing an elongated void in a poured concrete structure. The corrugate form is made by assembling a pair (or more) of mirror-image sheets by folding them in such a way to form either a square cross-section or octagonal cross-section sleeve. The edges of the outer sheets are formed into corrugate inner structures, or pads, which form ribs within the resulting sleeve.

U.S. Pat. No. 3,381,929, to Bancher, teaches a flat concrete construction form assembly produced using, preferably, a paper honeycomb core, fiberboard outer cover, and a lightweight metal framework holding the core and center coverings together. The spacing between a pair of these construction-form assemblies may be adjusted by use of a cooperating set of clips (which fit into grooves found in the lightweight metal framework) and some large U-shaped clips which space the set of form assemblies apart at a particular distance.

U.S. Pat. No. 5,098,059, to Sawyer, describes a concrete forming member produced from a core of polystyrene or polyurethane and preferably having a flexible, non-permeable plastic film appended to the core. The impermeable face may be contoured to define a decorative pattern, such as an artificial brick facing, or the cast concrete. In some variations of the invention, a structural element is appended to the remote side of the plastic forming member to allow support of the structure during concrete pouring.

None of the cited references show the use of concrete forms produced primarily of paper honeycomb, which forms are self-supporting, and which are physically able to support workers during the pouring step.

SUMMARY OF THE INVENTION

This invention is a form or internal core of a form which may be used during the step of pouring concrete to form voids or recesses in the resulting concrete structure. The device may be used in conjunction with permanent structural supports embedded in the poured concrete.

The form is generally an assemblage of various layers with honeycomb materials, preferably of paper, in an appropriate shape. The exterior surfaces may be covered with paper sheeting or corrugate. The bottom layers may, in turn, be assembled from a number of components to provide a hollow center and conserve materials of construction.

The form may be produced from paper, polymers, or metallic honeycomb. The form, if paper, may be waterproofed.

Honeycomb sheets are commercially available in composites in which an expanded honeycomb is glued to two facing sheets.

The form may be used by placing it on the surface upon which the concrete is to be poured. A number of forms may be arranged in a formation of choice. The form may then be used to support reinforcing steel or the like. The concrete is poured.

DESCRIPTION OF THE INVENTION

Figure 1:
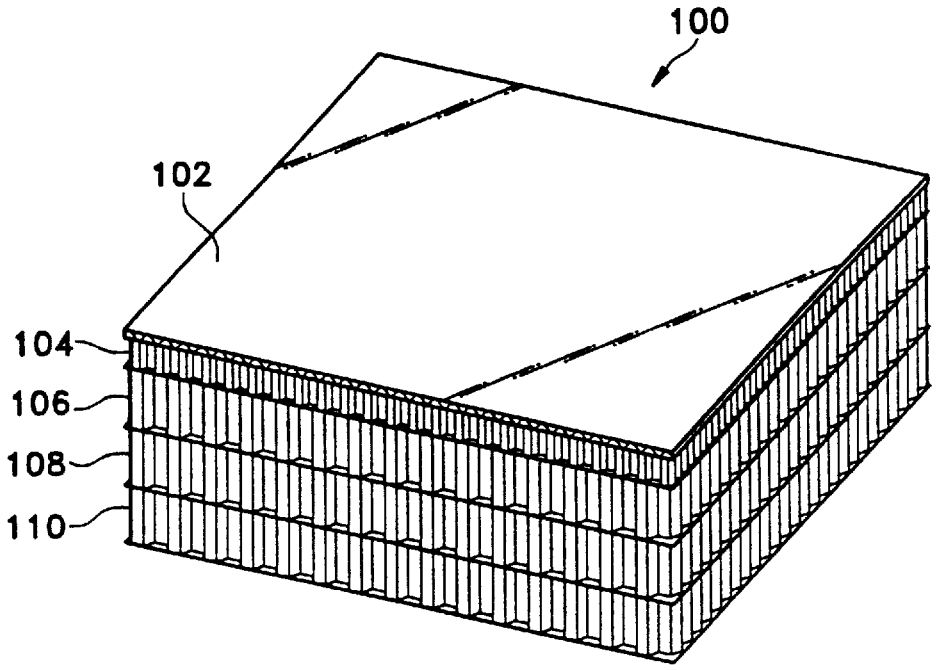
FIGS. 1 and 2 show, in front perspective view, forms made according to the present invention.

FIG. 1 shows a form (100) made according to the invention. In this variation, a top sheet (102)—typically of corrugate—forms the uppermost surface of the form (100). The word "corrugate" is used in the typical commercial use of the term in which two facing sheets of a kraft paper are separated by an undulating sheet of paper which is glued at the peal of its undulations to those facing sheets. Corrugate is desirable because of its cost, availability, and strength. Other sheet materials are also suitable for the top sheet (102) as desired, e.g., fiberboard such as MASONITE, plywood, OSB, etc. A paper sheet or single layer of cardboard may also be appropriate under some circumstances. Adhering to this top sheet (102) is a transition honeycomb layer (104) which desirably is a reasonably dense honeycomb sheet, e.g., typically having ¼"–¾" cells. This transition layer (104) has a higher cell concentration than the lower honeycomb layers (106, 108, 110) and is often for the purpose of acting as an intermediate between the top sheet (102) and the lower layers which may (and often are) of honeycomb sheets having significantly larger cells. The larger cell, lower or spacing layers (106, 108, 110) are less resistant to compression from a point or blunt source. The use of these two upper layers assists in permitting the workers to walk on the invention form even when the form is surrounded by wet cement. A good reference point for the average compression strength of the transition honeycomb layer (104) is in the range of 20–50 psi, preferably 30–40 psi.

The three lower layers, in this variation (106, 108, 110) are of a larger cell honeycomb and typically have a lower average compressive strength. For instance, we have found that for normal forms, honeycomb panels constructed from 2 inch cell honeycomb is adequate. Such honeycomb may have an average compression strength of only 5–6 psi or less. The higher strength transition layer permits the higher strength honeycomb layers to support workers during the time the concrrete is being poured. Honeycomb sheets having cell size of ¼ to 2½ inches are suitable, but a cell size of 1 to 2¼ inches is most desired.

The various honeycomb layers must adhere to each other lest the form not have the strength to withstand the step of pouring wet concrete. That is not to say that the honeycomb layers must be in contact, they may be separated by paper, corrugate, etc. Similarly, they may be glued or otherwise fixed in relation to each other. Long staples or other mechanical fasteners may be used to maintain this relationship.

Forms produced from lighter weight papers, e.g., 20 to 28 psi paper, may be used where ultimate and quick biodegradability is desired. The papers and/or honeycomb materials may be waterproofed if needed, such as when slow-curing concrete or wet concrete having high water content is contemplated.

A typical form such as shown in FIG. 1 might have a height of 12" and upper surface dimensions of 36" by 36". Such sizes are only examples and dimensions of any size are suitable in this invention.

The variation shown in FIG. 1 need not have three lower layers (106, 108, 110) of equal thickness, obviously they may be of varying thicknesses and of any of a variety of sizes.

As will be discussed below, the vertical sides of the variation in FIG. 1 may additionally have a paper or corrugate sheet adherent to at least a portion of those surfaces.

Figure 2:
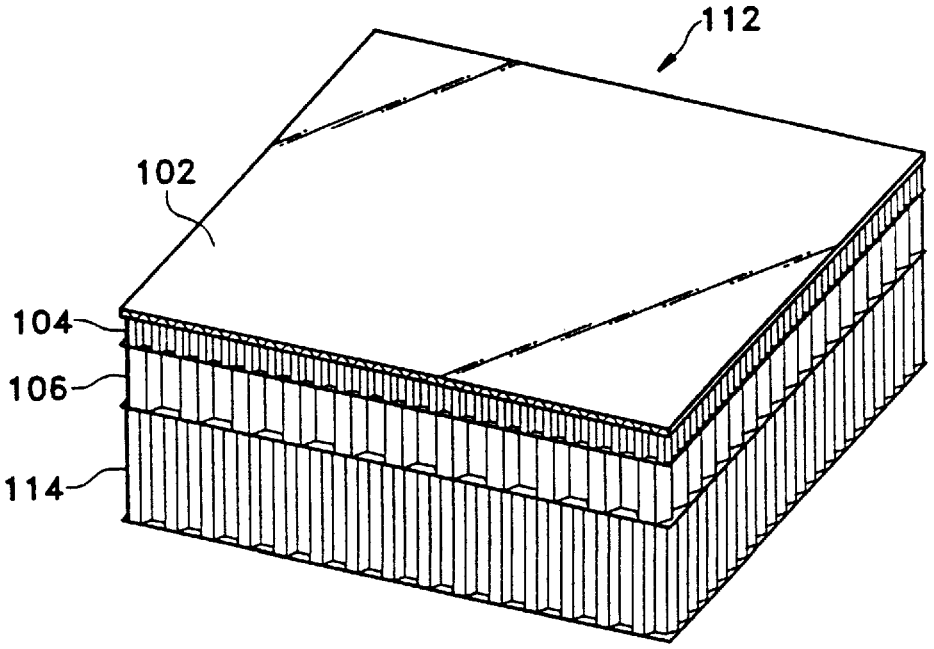

FIG. 2 shows another variation of the inventive form (112) in which the sequence of adhering layers use honeycomb panels of varying thicknesses. In this variation of the form (112), the upper or top sheet (102) is shown to be a corrugate material as was the top sheet in FIG. 1. The variation also has a transition layer or upper honeycomb panel (104) of similar physical parameter to that described in conjunction with FIG. 1. The top sheet (102) in each of the variations described herein may, again, be eliminated in certain instances or may be of a lower or higher strength. For instance, a mere sheet of kraft paper is acceptable if the upper surface is not to be subjected to abuse or hard use. Similarly, non-corrugate cardboard may be suitable. The top sheet may be of a non-paper material such as TYVEK (polypropylene) or the like if water resistance is desirable on the upper surface.

The variation of materials discussed above with respect to the FIG. 1 form are also suitable with respect to the FIG. 2 form.

Figure 3:
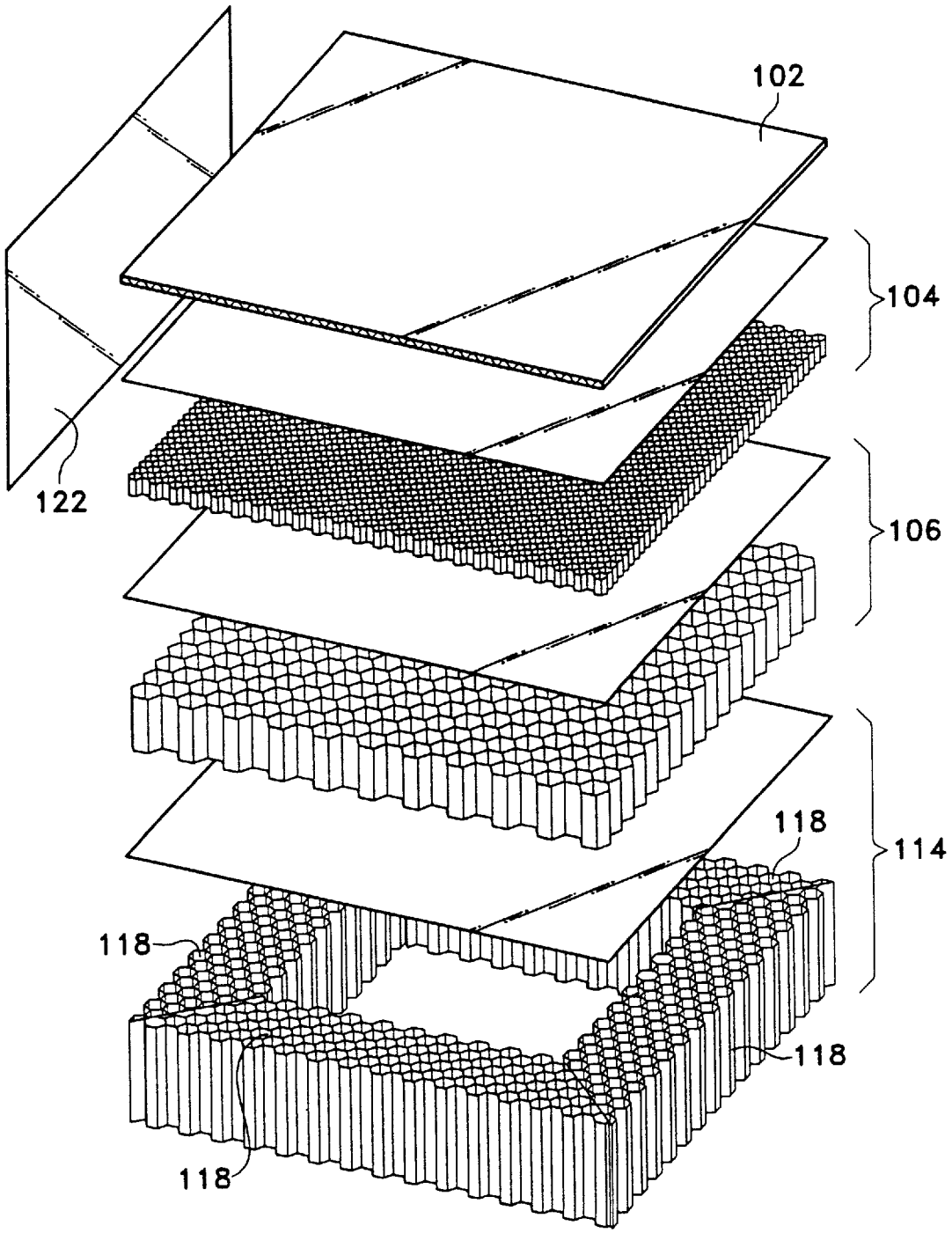
FIG. 3 shows a blow-up of a typical form made according to the invention having paper covering.

FIG. 3 shows a blow-up of the FIG. 2 form illustrating the option of utilizing a hollow base and a paper cover on the vertical surfaces. The upper surface (102) may be a corrugate; the transition or upper honeycomb panel (104) is a honeycomb composite of a paper sheet and an expanded honeycomb panel. A lower paper sheet on the honeycomb panels is usually present but is excluded from the drawing for simplicity of explanation. The lower honeycomb layer (114) is shown to be a composite of four blocks (118) which are mitered at the corners to form a hollow square. Mitering the corners at 45° results in a form which distributes the side-load forces on the form and prevents the form from collapsing due to excessive shear loads on lines between the various blocks. The hollow area (120) saves on the amount of honeycomb material needed but does not significantly affect the strength of the form. The hollow area (120) additionally provides a reservoir area for mud which may rise during the concrete pour. This reservoir helps prevent the buckling concrete as a result of mud expansion—a common occurrence when pouring concrete in dry, high clay content soils.

Facing sheet (122) is depicted in the drawing as a single sheet. The other three sheets are omitted for simplicity of explanation. The facinf sheet (122) extends down from the upper face of the transition or upper honeycomb panel (104) or from the top sheet (102) if such is used. Obviously, the facing sheet (122) may be a single piece of paper (or corrugate) wrapped around the form and glued to the form.

Figure 4:
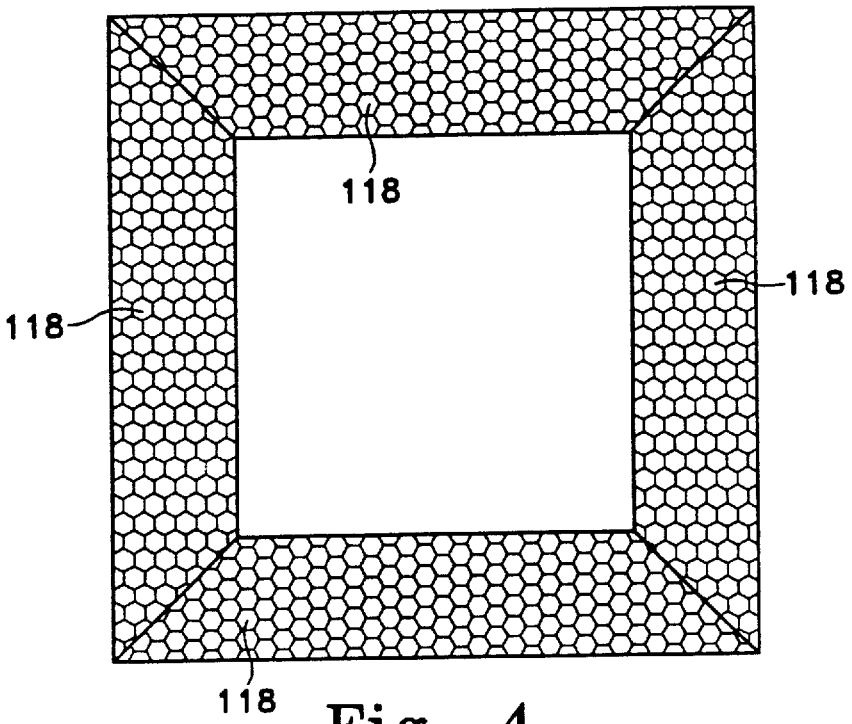
FIGS. 4 and 5 show bottom views of a form made according to the invention showing variations having a hollow base.
Figure 5:
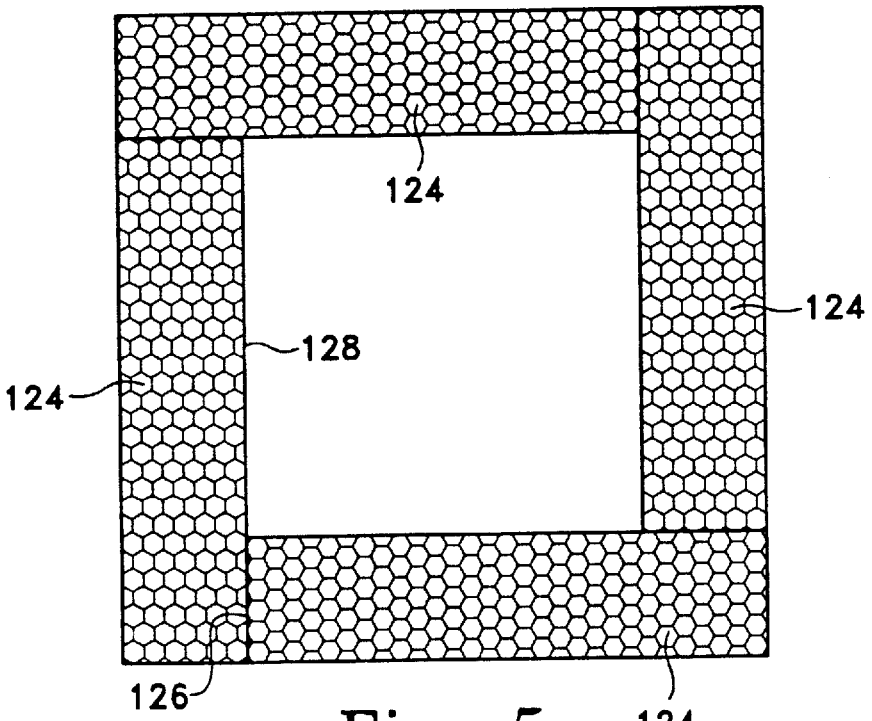

FIGS. 4 and 5 show bottom views of two variations of the inventive forms depicting ways in which the lower blocks may be fitted to form a rectangular form. In FIG. 4, the blocks (118) are mitered to form the rectangle. In FIG. 5, the blocks (124) are themselves rectangular and placed so that their surfaces (126) fit against their neighbor's side faces (128) to form the resulting rectangle. Obviously, other variations are easily envisaged for meshing the lower blocks.

Figure 6:
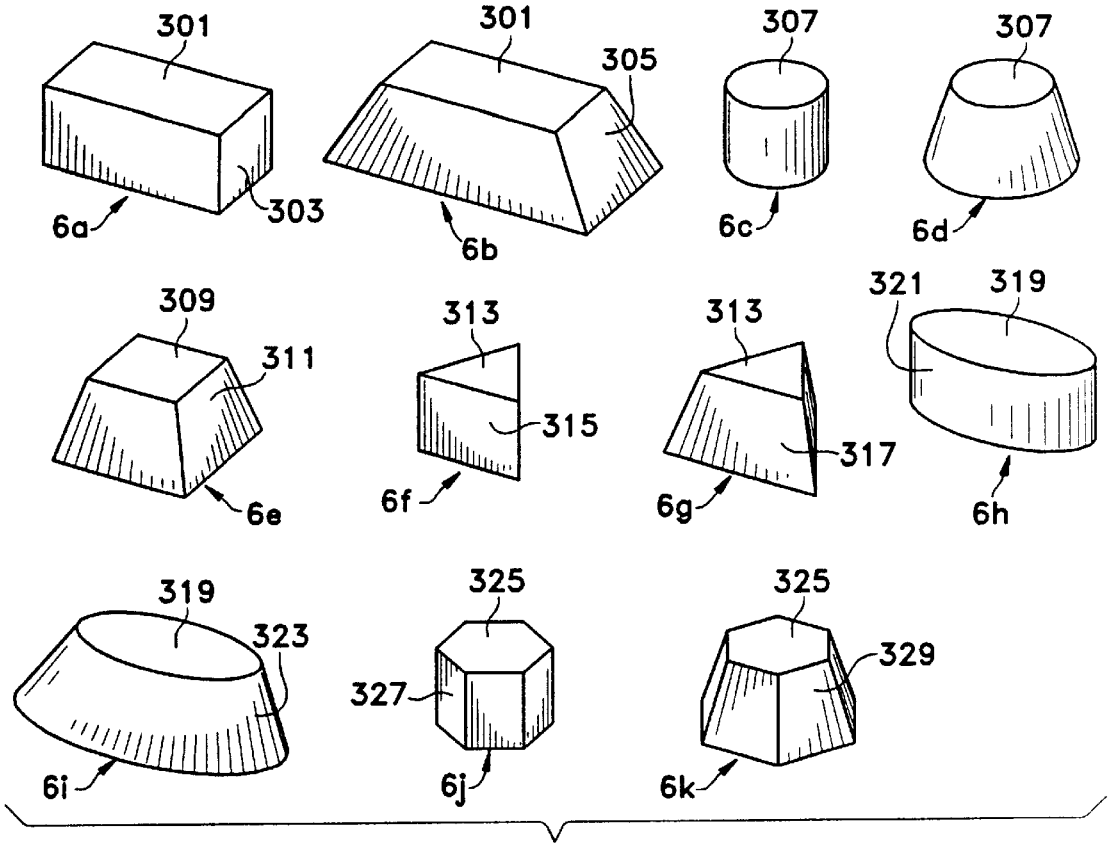
FIG. 6 shows a variation of the shape of the inventive form.

FIG. 6 shows the exterior of a variety of from shapes made according to the invention. The side walls on the forms may be vertical or canted to provide a larger lower surface than upper surface. In forms (6*a*) and (6*b*), the upper and lower surfaces (301) are rectangular. The overall form of form 6*a* is rectangular. The side walls (305) of form 6*b* are canted. The form (6*c*) is cylindrical. Form (6*d*) is a truncated cone having a lower surface larger than the upper surface (307).

Form (6*c*) has a square upper surface (309) but with canted side surfaces (311). Forms (6*f*) and (6*g*) have triangular upper surfaces (313). Form (6*f*) has vertical form sides (315) and form (6*g*) has canted or non-vertical sides.

Forms (6*h*) and (6*i*) have oval upper surfaces (319). Form (6*h*) has a smooth vertical surface (321). At least a portion of side surface (323) is not perpendicular to the form's (6*i*) lower surface.

Forms (6*j*) and (6*k*) have polygonal upper surfaces (325), in this case, hexagonal. Form (6*j*) has vertical sides (327) and form (6*k*) has non-vertical sides (329).

Although the forms shown in FIG. 6 are all "regular" in that an axis placed vertically through the center of each of the forms will exhibit symmetry about that axis, such symmetry is not necessary nor always desirable. Irregularly shaped upper surfaces and combinations of vertical and non-vertical side surfaces are also a part of this invention.

It is within the scope of this invention to place orifices or slots or other shapes in the vertical surfaces to hang structural steel or the like from those vertical surfaces.

Figure 7:
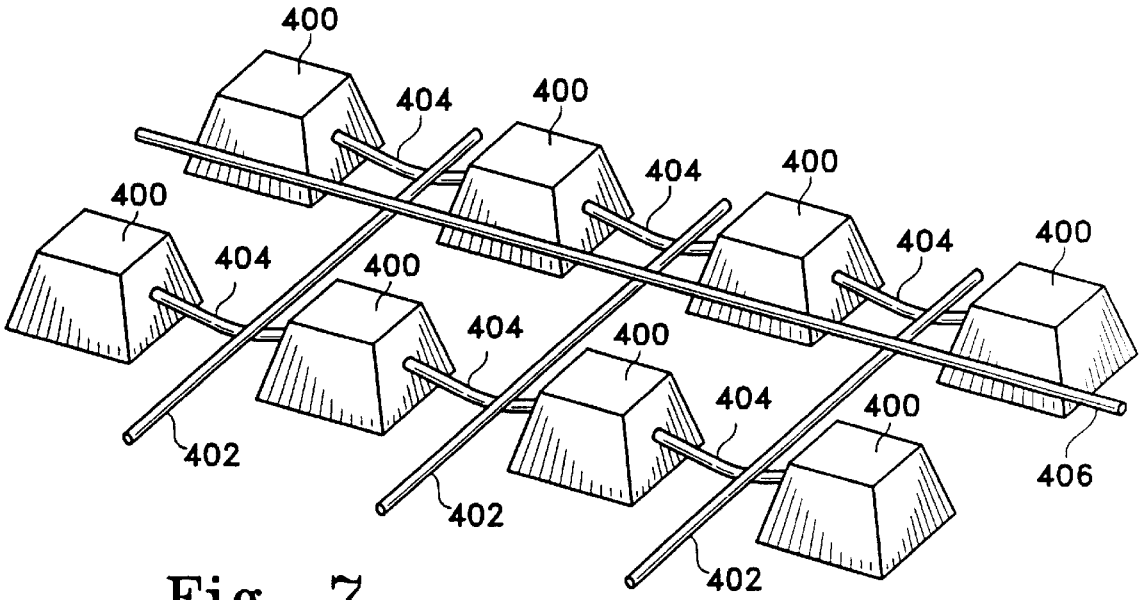
FIGS. 7 shows a method of placing the forms prior to the step of pouring concrete.

FIG. 7 shows a schematic depiction of one way to use the concrete forms of this invention. In this arrangement, a series of forms (400) are placed as desired. To support structural steel or "rebar" (402), hangers (404) may be placed between adjacent forms (400). Additional structural steel (406) may also be placed amongst the other structural steel. Once the forms and structural steel are in place, wet concrete is poured. The upper surfaces of the forms (400) may be walked upon by those pouring the concrete during operations such as removal of air bubbles and voids using vibrators. The remainder of the concrete is then poured.

Although the invention has been described both by direct description and by example, the scope of the invention is not so limited. Although the claims describe the literal scope of the invention, it is my intent that the claimed invention include the equivalents of these claims.

I claim as my invention:

1. A paper core member of a casting form for casting voids inside of cast concrete, said core member comprising:

a load distributing upper honeycomb panel having a first cell size of ¼"–¾" and having an upper face and a lower face;

a load carrying lower honeycomb panel having a second cell size, said second cell size being larger than said first cell size and having an upper limit of 2¼", said lower honeycomb panel having an upper face and a lower face;

where the upper honeycomb panel is fixedly attached to the lower honeycomb panel;

wherein said core member defines an area inside said casting form for a void inside the formed concrete.

2. The core member of a casting form for casting voids inside of cast concrete of claim 1 additionally comprising a top sheet selected from paper or corrugate and fixedly attached to the upper face of the upper honeycomb panel.

3. The core member of a casting form for casting voids inside of cast concrete of claim 1 additionally comprising one or more honeycomb spacers fixedly positioned on the lower face of the lower honeycomb panel.

4. The core member of a casting form for casting voids inside of cast concrete of claim 2 additionally comprising one or more honeycomb spacers fixedly positioned on the lower face of the lower honeycomb panel.

5. The core member of a casting form for casting voids inside of cast concrete of claim 1 where the concrete forming member has side surfaces extending downwardly from the upper face of the upper honeycomb panel and said side surfaces are covered with paper or corrugate.

6. The core member of a casting form for casting voids inside of cast concrete of claim 2 where the concrete forming core member has side surfaces extending downwardly from the top sheet and said side surfaces are covered with paper or corrugate.

7. The core member of a casting form for casting voids inside of cast concrete of claim 1 where the lower honeycomb panel is hollow.

8. The core member of a casting form for casting voids inside of cast concrete of claim 3 where the lower honeycomb panel is hollow and the one or more honeycomb spacers are hollow.

9. A paper core member of a casting form for casting voids inside of cast concrete comprising:

a corrugate top sheet having an upper surface and a lower surface, an upper honeycomb panel having a cell size comparatively smaller than cell sizes in a lower honeycomb panel and an upper surface and a lower surface and fixedly attached to the lower surface of the corrugate top sheet, at least two lower honeycomb panels fixedly attached to the lower surface of the upper honeycomb panel and having comparatively larger cell sizes than the cell size in the upper honeycomb panel.

10. The core member of a casting form for casting voids inside of cast concrete of claim 9 where the upper honeycomb panel has a cell size of ¼"–¾".

11. The core member of a casting form for casting voids inside of cast concrete of claim 9 where the at least two lower honeycomb panels have cell sizes of ¼"–2¼".

12. The core member of a casting form for casting voids inside of cast concrete of claim 9 where the concrete forming core member has side surfaces extending downwardly from the top sheet and said side surfaces are covered with paper or corrugate.

* * * * *

UNITED STATES PATENT AND TRADEMARK OFFICE

CERTIFICATE OF CORRECTION

PATENT NO. : 5,855,808
DATED : January 5, 1999
INVENTOR(S) : Frank B. DeBerardino It is certified that error appears in the above-identified patent and that said Letters Patent is hereby corrected as shown below:

On the title page, item [56]

In the "References Cited" section, add --3,512,747 5/1970 Stark.....249/134--

In column 3, line 26, "concrrete" should be --concrete--

Signed and Sealed this

Fourth Day of July, 2000

*Attest:*

*Attesting Officer*

Q. TODD DICKINSON

*Director of Patents and Trademarks*